US005802876A

United States Patent [19]

Miller et al.

[11] Patent Number: 5,802,876

[45] Date of Patent: Sep. 8, 1998

[54] BRACELET

[76] Inventors: Anna L. Miller; Austin B. Miller, both of 2197 Timber Trace Cir., Cleveland, Tenn. 37311

[21] Appl. No.: 615,507

[22] Filed: Mar. 12, 1996

[51] Int. Cl.[6] ..... A44C 5/00

[52] U.S. Cl. ..... 63/3; 63/21

[58] Field of Search ..... 63/3, 4, 2, 21, 63/22, 1

[56] References Cited

U.S. PATENT DOCUMENTS

| | | | |
|---|---|---|---|
| 3,073,492 | 1/1963 | Berger | 63/3 |
| 4,078,660 | 3/1978 | Lerro . | |
| 4,284,986 | 8/1981 | Amortegui . | |
| 4,984,683 | 1/1991 | Eller | 63/1.1 |
| 5,241,466 | 8/1993 | Perry et al. . | |

FOREIGN PATENT DOCUMENTS

| | | | |
|---|---|---|---|
| 6030812 | 2/1994 | Japan | 63/21 |
| 9500939 | 1/1995 | WIPO . | |

*Primary Examiner*—Kien T. Nguyen
*Attorney, Agent, or Firm*—Chase & Yakimo

[57] ABSTRACT

A bracelet for identifying to third parties that important legal and/or health care information of the wearer is stored therein. The bracelet includes a bracelet chain having first and second layers of link-like elements connected to a front panel, the front panel having a configuration and/or indicia thereon indicative of the type of information stored therein. The housing within the panel receives a storage medium, e.g. a computer chip, having the information recorded thereon in a machine-readable form. A releasable cover closes said housing. The housing is preferably made of a non-permeable material so as to preclude the passage of magnetic flux therein and deleteriously modify the encoded information on the storage medium.

10 Claims, 4 Drawing Sheets

BRACELET

BACKGROUND OF THE INVENTION

This invention relates to a bracelet for storing in machine-readable form a document therein and, more particularly, to a bracelet indicative of the presence of a living will or other important legal document therein.

Today there is a concern that one who may suddenly suffer from an illness need not undergo unnecessary prolonged hospital care. Accordingly, the use of living wills has become a burgeoning one. It is desirable to have such a will, as well as other important documents, carried on one's person so as to make such information instantly available to pertinent personnel.

It has been found that in some instances an incapacitated person has important health and legal information on her person but such information has been ignored. This is particularly important when an illness strikes without warning. Moreover, a person, incapacitated by the sudden illness, is unable to advise others of his/her testamentary desires. Thus, it is desirable to be able to secure such information on the person in a readily identifiable manner so as to afford the wearer the desired advantages of the accompanying documents, such as the living will, organ donation, powers of attorney, etc.

In response thereto we have provided a bracelet and method of using the same, the bracelet having an easily identifiable configuration with indicia thereon indicating that the bracelet contains instructions pertinent to the wearer's legal and health care desires. The bracelet, when used in connection with a nationwide promotion, thereof will be easily recognized as containing a living will or other important document.

The bracelet generally comprises a front panel in the form of angel wings with a double layer, link-like chain for encircling the arm. Within the front panel is a magnetically protected housing for containing an information storage medium, the housing being closed by a releasable panel. On the medium, e.g. a computer chip, the appropriate information, e.g. the living will, powers of attorney and the like, is recorded. Further indicia appears on the front panel which will further associate the information stored on the medium with its subject matter such as the legal scales of justice for the living will.

It is therefore a general object of this invention to provide a bracelet indicative of the storage of important legal and/or health related information therein.

Another object of this invention is to provide a bracelet, as aforesaid, having a design informing the public of the location of important legal and/or health care information being stored therein.

Still another object of this invention is to provide a bracelet, as aforesaid, having a data storage medium protected from the outside elements.

A further object of this invention is to provide a bracelet, as aforesaid, wherein the storage medium is easily inserted into and/or removed from the bracelet proper.

A still further object of this invention is to provide a bracelet, as aforesaid, the pertinent information being embedded in a storage medium easily readable by computer devices.

Another object of this invention is to provide a bracelet, as aforesaid, presenting a configuration indicating the presence of a living will therein.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
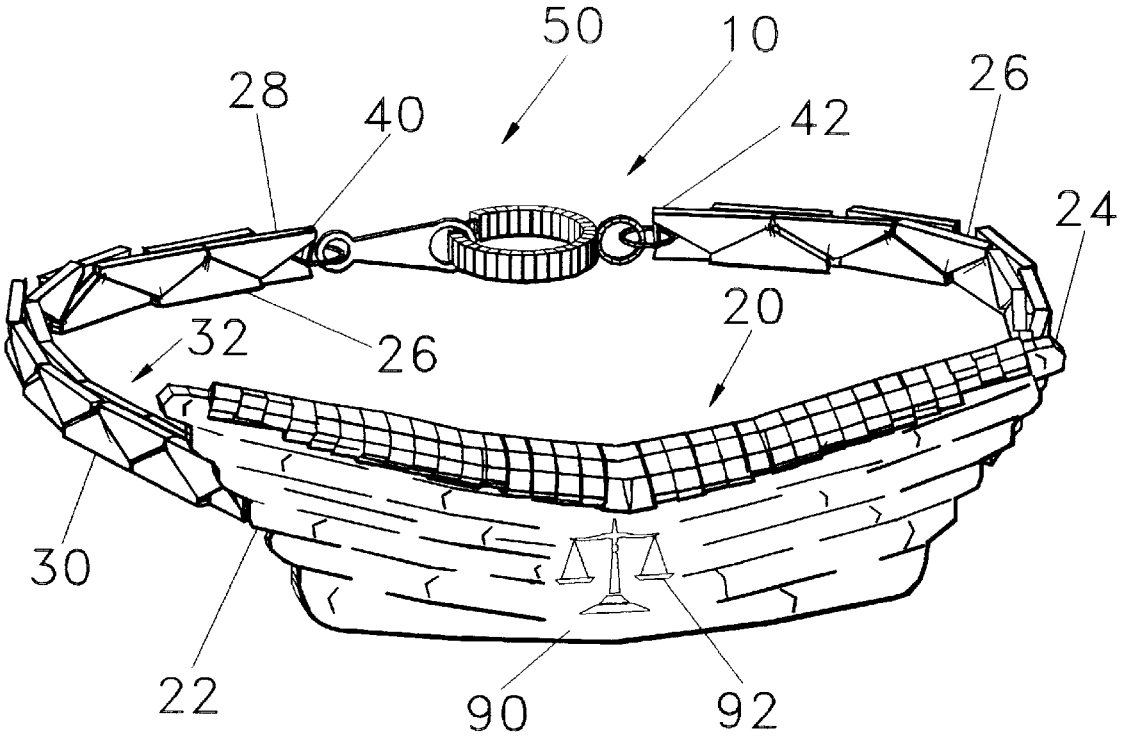
FIG. 1 is a front view of the bracelet.
Figure 2:
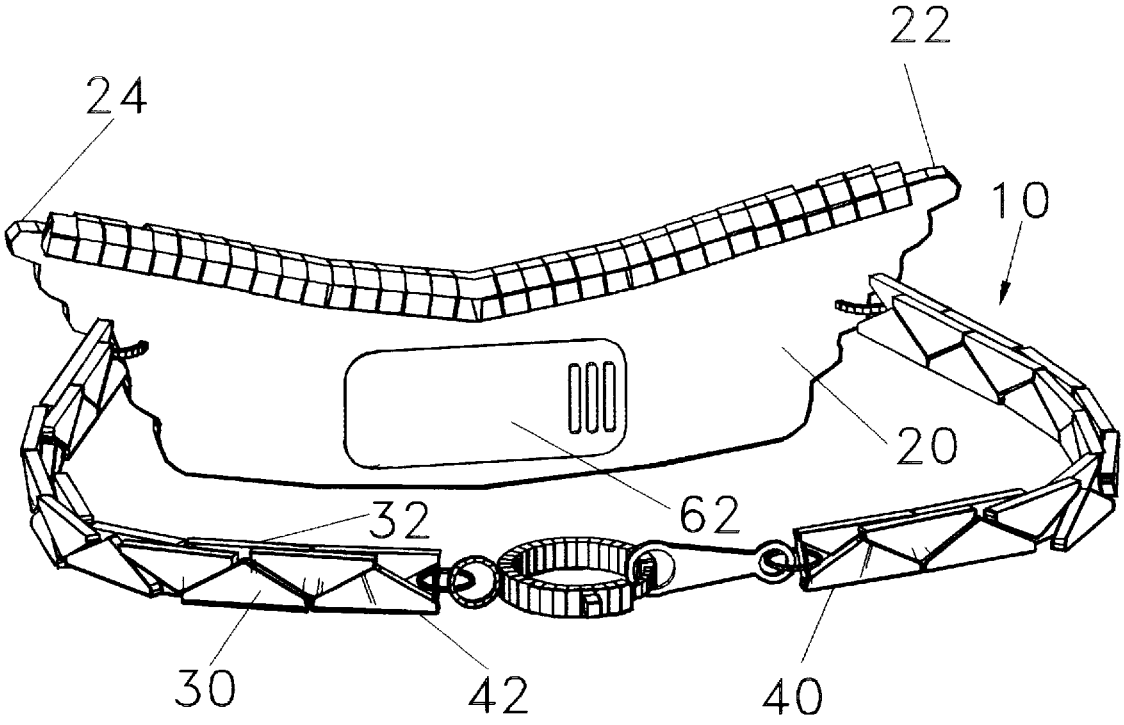
FIG. 2 is a rear view of the bracelet.
Figure 3:
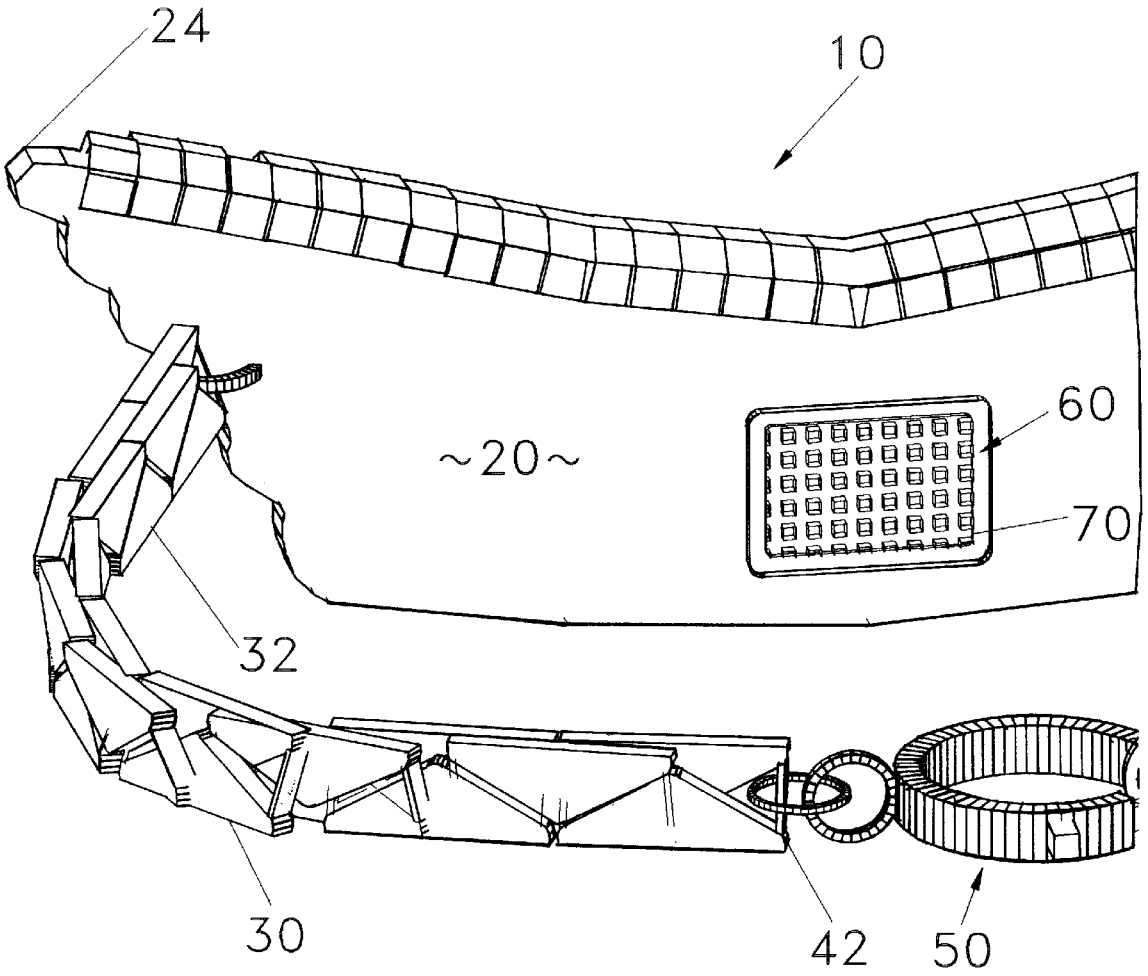
FIG. 3 is a partial rear view of the bracelet, on an enlarged scale, showing the removal of the panel from the storage medium housing.

Turning more particularly to the drawings, FIG. 1 generally shows the bracelet 10 as having an identifiable angel wing panel 20 configuration, the bracelet 10 being preferably made of a sturdy material. It is desirable that the bracelet 10 panel 20 is not permeable to magnetism or the like so as to protect the computer-readable data stored thereon. Extending from opposed ends 22, 24 of the angel wing panel 20 is a chain 26 comprising a plurality of layers having links 28 therein, the chain 26 sized for encircling the wrist of the wearer. The bracelet chain 26 preferably comprises a first outside layer 30 and second inside layer 32 of links bound together. This construction diminishes the possibility that a breakage of one of the bracelet links will cause the entire chain 26 to disengage from the wrist of the wearer. A fastener assembly 50 extends between the ends 40, 42 of the chain 26 so as to secure the chain about the wrist of the wearer.

Embedded in the front panel 20 of the bracelet is a housing 60 for storing a machine-readable storage medium 70 therein. The medium will contain in a machine-readable form the appropriate document, such as a living will or the like. The medium 70 is easily removed from the housing 60 upon removal of the panel 62. It is understood that the medium may be a computer chip which can be read by available computer reading devices. It is preferred that the housing 60 and panel 62 be made of or lined with a material which is not permeable to magnetic flux so as to maintain the encoded format of any computer stored information on the medium 70.

Figure 4:
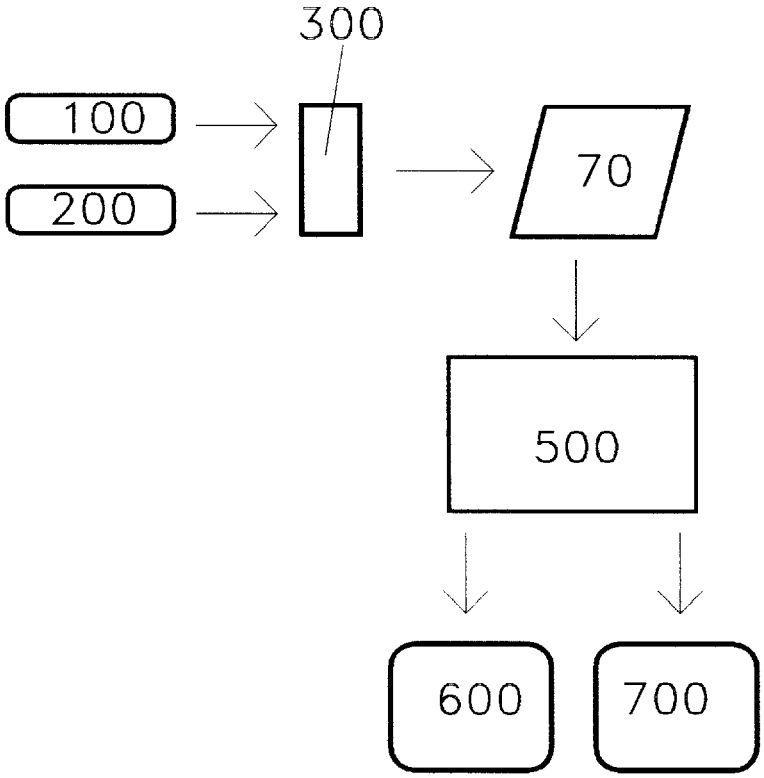
FIG. 4 is a block diagram illustrating the method of placement of information on the storage medium housed by the bracelet.

The FIG. 4 block diagram shows the data input 100 and scanner 200 which feeds information into an encoder 300. The encoder 300 places the information onto the memory chip 70, e.g. an EPROM memory module. A conventional retrieval system 500, capable of reading the EPROM chip, displays the information on chip 70 on a CRT 600 or the like and/or converts the data into a hard copy by the printer 700.

It is understood that the above bracelet 10 will be utilized in connection with a national identification system so that various pertinent personnel such as medical, police, security and legal personnel will recognize such a bracelet 10 as having legal and health care information encoded on the enclosed storage medium 70. In connection with such identification further graphics may appear on the front panel 20 of the bracelet which will further identify the type of contents of the information within the housing. In this case the terminology "living will" 90 along with the scales of justice 92 are provided.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A bracelet for storage of machine-readable information comprising:

a bracelet chain;

a front panel connected to said chain, said panel having a configuration indicative of the type of information being stored therein;

a storage medium containing the information in a machine-readable form;

a housing in said panel for containing said medium therein, said housing constructed of a material impermeable to magnetic flux;

a releasable cover for said housing, said cover constructed of a material impermeable to magnetic flux, said cover cooperating with said housing to preclude magnetic flux from deleteriously affecting the information on said storage medium.

2. The bracelet as claimed in claim 1 wherein said bracelet chain comprises first and second layers of material bound together wherein one of said layers of material will maintain said chain about a wrist of a wearer upon breakage of the other of said layers of material.

3. The bracelet as claimed in claim 1 wherein said housing material includes a lining about said housing impermeable to magnetic flux.

4. The bracelet as claimed in claim 1 wherein said configuration simulates angel wings.

5. The bracelet as claimed in claim 1 wherein the information is a living will.

6. A bracelet comprising:

a bracelet chain;

a front panel connected to said chain, said panel having a preselected configuration indicative of a type of information being stored therein;

a computer chip containing the information in a machine-readable form;

a housing in a rear surface of said panel for containing said chip therein, said housing constructed of a material resistant to forces affecting the machine-readable information on said computer chip;

a releasable cover for said housing, said cover constructed of a material resistant to forces deleteriously affecting the machine-readable information on said computer chip, whereby said bracelet maintains the integrity of information on said chip stored in said housing upon a closure thereof.

7. The bracelet as claimed in claim 6 wherein said bracelet chain comprises first and second layers of material bound together wherein one layer of material will maintain said chain about a wrist of a wearer upon breakage of another layer of material.

8. The bracelet as claimed in claim 6 wherein said configuration simulates angel wings.

9. The device as claimed in claim 6 wherein said housing construction comprises a lining about said housing to protect said chip from outside elements affecting the machine-readable information.

10. The bracelet as claimed in claim 9 wherein said lining of said housing and said cover are impermeable to flux from a magnet.

* * * * *